United States Patent [19]

Basil, Jr. et al.

[11] Patent Number: 4,908,589

[45] Date of Patent: Mar. 13, 1990

[54] DIELECTRICALLY LOADED WAVEGUIDE SWITCH

[75] Inventors: Richard V. Basil, Jr., Chatsworth; Juri G. Leetmaa, Los Angeles, both of Calif.

[73] Assignee: Hughes Aircraft Company, Los Angeles, Calif.

[21] Appl. No.: 99,401

[22] Filed: Sep. 21, 1987

[51] Int. Cl.[4] ..... H01P 1/10; H01P 5/12

[52] U.S. Cl. ..... 333/106; 333/108

[58] Field of Search ..... 200/11 R, 153 S, 155 R, 200/504; 333/222, 101–108; 339/239, 258–262

[56] References Cited

U.S. PATENT DOCUMENTS

| | | | |
|---|---|---|---|
| 2,759,153 | 8/1956 | Charles | 200/153 S |
| 2,761,137 | 8/1956 | Van Atta et al. | 333/239 X |
| 2,766,355 | 10/1956 | Cherry | 200/153 S |
| 2,816,198 | 12/1957 | Cherry | 200/153 S |
| 2,822,524 | 2/1958 | Williston | 333/239 |
| 3,001,053 | 9/1961 | Rubin | 200/153 S |
| 3,346,825 | 10/1967 | Scott et al. | 333/258 |
| 3,577,105 | 5/1971 | Jones, Jr. | 333/239 |
| 4,490,700 | 12/1984 | Stern et al. | 333/258 |
| 4,603,311 | 7/1986 | Mage | 333/222 X |

*Primary Examiner*—J. R. Scott

*Attorney, Agent, or Firm*—Steven M. Mitchell; Mark J. Meltzer; A. W. Karambelas

[57] ABSTRACT

A dielectrically loaded waveguide switch is disclosed which provides high power handling capability, small size and low weight. The invention includes first and second dielectrically loaded waveguides selectively connected by a switch. In a specific embodiment of the invention, the switch includes a third dielectrically loaded waveguide mounted for communication with said first and second waveguides upon switch actuation.

12 Claims, 1 Drawing Sheet

DIELECTRICALLY LOADED WAVEGUIDE SWITCH

BACKGROUND OF THE INVENTION

1. Field of the Invention

The present invention relates to microwave circuits. More specifically, the present invention relates to switches used to connect signals from two or more microwave channels.

While the present invention is described herein with reference to a particular embodiment for an illustrative application, it is understood that the invention is not limited thereto. Those having ordinary skill in the art and access to the teaching provided herein will recognize additional modifications, applications and embodiments within the scope thereof.

2. Description of the Related Art

Microwave switches selectively connect channels in microwave circuits and systems. Two categories of switches pertinent to this invention are coaxial switches and waveguide switches.

Coaxial switches are known to have several limitations. The most severe being power handling capability. The maximum average power that a coaxial switch can handle is typically limited by overheating of the internal switch materials due to RF losses. Conventional designs typically exhibit poor thermal conductivity from the transmission line center conductor. Poor thermal conductivity can lead to excessive heat build-up which can cause the safe operating temperatures of the materials being used to be exceeded resulting in failures.

Further, the peak power is limited by multipacting breakdown. Multipacting breakdown is a resonant radio frequency discharge which is attributable to secondary emissions of electrons from discharging surfaces when a radio frequency field of sufficient magnitude and proper frequency is applied across a gap in a vacuum. Multipacting causes disruption of communications and if not controlled can lead to destruction of the switch.

Many coaxial switches of conventional design are inclined to suffer from multipacting breakdown at low power levels and certain (i.e. L and C) frequency ranges. As a result, many current applications, particularly those of spacecraft systems, are increasingly requiring power handling capabilities beyond those of such conventional coaxial switches.

Coaxial switches are also generally more mechanically complex than other designs. As a result, many switch configurations, though realizable, are difficult and costly to implement in a coaxial design.

Waveguide switches do not have the mechanical complexity or the power limitations of the coaxial switches. However, these switches are generally much larger and heavier than coax switches for C band and lower frequencies. Thus, current waveguide switches are generally not acceptable for use in many spacecraft applications.

There is therefore a recognized need in the art for a high power handling, small, lightweight microwave switch suitable for spacecraft systems and other applications demanding a high ratio of power handling capability to size and weight.

SUMMARY OF THE INVENTION

The shortcomings demonstrated by the related art are substantially addressed by the dielectrically loaded waveguide switch of the present invention. The invention provides a high power handling switch with small size and low weight. The dielectrically loaded waveguide switch of the present invention includes first and second dielectrically loaded waveguides selectively connected by a switch. In a specific embodiment of the invention, the switch includes a third dielectrically loaded waveguide mounted for communication with said first and second waveguides upon switch actuation.

DESCRIPTION OF THE INVENTION

Figure 1:
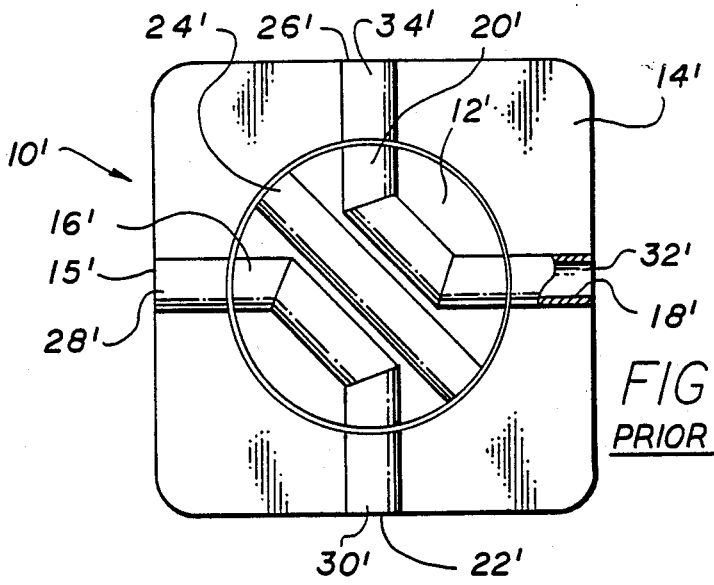
FIG. 1 PRIOR ART
FIG. 1 shows a waveguide switch constructed in accordance with the teaching of the related art.

The present invention is described below after a review of the waveguide switch of the related art. FIG. 1 shows a typical conventional switch 10' The switch 10' is partially in section and includes a rotor 12' which contains a plurality of waveguides 16', 20' and 24' and a stator 14' which contains a plurality of waveguides 15', 18', 22' and 26'. The rotor 12' and stator 14' are typically made of aluminum or other suitable material. The waveguides 15', 16', 18', 20', 22', 24', and 26' are typically rectangular, square or circular housings each of which is sized to propagate at a particular frequency. The rotor 12' is rotated to align the desired waveguides for transmission of a microwave signal between the appropriate waveguide ports 28', 30', 32' and 34'.

When operating in the configuration of FIG. 1 and with the rotor positioned as shown, a microwave signal supplied to waveguide port 28' will propagate through waveguides 15', 16' and 22' to waveguide port 30' and a microwave signal supplied to waveguide port 32' will propagate through waveguides 18', 20' and 26' to waveguide port 34'. As is well known in the art, the number and configuration of the waveguides 15', 16', 18', 20', 22', 24', and 26' may vary.

Figure 2:
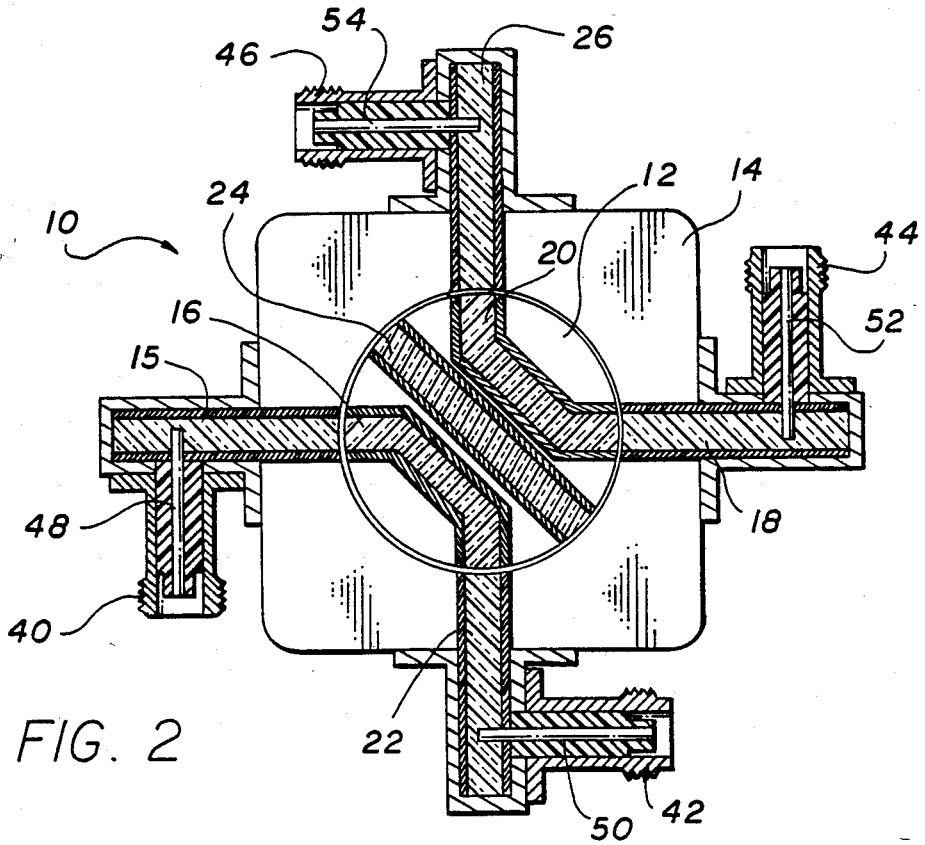
FIG. 2 shows an illustrative embodiment of the dielectrically loaded waveguide switch of the present invention.

FIG. 2 shows a corresponding illustrative embodiment of a dielectrically loaded waveguide switch 10 utilizing the teachings of the present invention. The switch 10 is shown in section and includes a rotor 12 which contains a plurality of dielectrically loaded waveguides 16, 20 and 24 and a stator 14 which contains a plurality of dielectrically loaded waveguides 15, 18, 22, and 26. The dielectrically loaded waveguides 15, 16, 18, 20, 22, 24, and 26 differ from waveguides 15', 16', 18', 20', 22', 24' and 26' of the related art in that waveguides 15, 16 18, 20, 22, 24 and 26 are loaded with a dielectric material, and dielectrically loaded waveguides 15, 22, 18 and 26 of the present invention differ from waveguides 15', 22', 18' and 26' of the related art in that dielectrically loaded waveguides 15, 22, 18 and 26 are coupled to coaxial connectors 40, 42, 44, and 46 respectively through coaxial probes 48, 50, 52, and 54 respectively. Note that the size of dielectrically loaded waveguides 15, 16, 18, 20, 22, 24 and 26 is reduced from the size of waveguides 15', 16', 18', 20', 22', 24' and 26' of the related art by the square root of the dielectric constant ($E_r$) of the loading material.

A common low loss dielectric material fabricated from Barium tetratitanate has an $E_r$ of 37. Using this dielectric material, the dielectrically loaded waveguides 16, 16, 18, 20, 22, 24 and 26 of the present invention can be reduced in size to less than one sixth that of waveguides 15', 16', 18', 20', 22', 24' and 26' of the related art. The invention is not limited to any particular size of waveguide or type of dielectric material. Those skilled in the art having access to the present teachings will be able to design dielectrically loaded waveguide switches using dielectric materials suitable for the switch size, and microwave frequency desired for a particular application.

The rotor 12 is essentially the same as the rotor 12' of the related art except that the size of the rotor 12 can be substantially reduced due to the reduced size of waveguides 16, 20 and 24. The stator 14 is essentially the same as the stator 14' of the related art with the exception that coaxial connectors 40, 42, 44 and 46 are mounted on stator 14 and the size of stator 14 is reduced due to the reduced size of dielectrically loaded waveguides 15, 18, 22 and 26. It will be appreciated by those skilled in the art that connectors 40, 42, 44, and 46 may be SMA or other suitable connectors without departing from the scope of the present invention. ("SMA" is from the military specification for coaxial cable C 39012 and means "subminiature series A type connector".) In addition, transitions to dielectrically loaded waveguides or to standard waveguides could be used in place of a coaxial connector without departing from the scope of the present invention.

In operation in the configuration of FIG. 2 and with the rotor in the position shown, a microwave signal supplied to coaxial connector 40 will propagate along coaxial probe 48 and through dielectrically loaded waveguides 15, 16 and 22 to coaxial probe 50 of coaxial connector 42 and a microwave signal supplied to coaxial connector 44 will propagate along coaxial probe 52 and through dielectrically loaded waveguides 18, 20, and 26 to coaxial probe 54 of coaxial connector 46. It should be noted that the above illustration is only an example of a possible configuration. Similarly, by rotating rotor 12, different dielectrically loaded waveguides will be aligned, to allow a microwave signal to propagate in either direction between coaxial probes of different coaxial connectors. It will be appreciated by those skilled in the art that the configuration of the switch and the number of waveguides may vary without departing from the scope of the present invention.

While the present invention has been described herein with reference to an illustrative embodiment and a particular application, it is understood that the invention is not limited thereto. Those having ordinary skill in the art and access to the teachings of the present invention will recognize additional modifications and applications within the scope thereof.

For example, the present invention is not limited to switches. Instead it may be used wherever it is desired to reduce the size of a waveguide. In addition, the present invention allows for a variety of system configurations by which waveguides are switched.

It is therefore intended by the appended claims to cover any and all such modifications, applications and embodiments.

Accordingly, what is claimed is:

1. A waveguide switch comprising:

a first waveguide having a solid dielectric material therein;

a second waveguide having a solid dielectric material therein; and switch means for connecting said first waveguide to said second waveguide.

2. The waveguide switch of claim 1 wherein said switch means includes a rotor and stator.

3. The waveguide switch of claim 2 wherein said rotor is a rotatable first housing surrounding a third waveguide having a solid dielectric material therein and said stator is a stationary second housing surrounding said first and second waveguides.

4. The waveguide switch of claim 3 including first and second connector means for communicating with said first and second waveguides respectively.

5. The waveguide switch of claim 4 wherein said first and second connector means are mounted on said second housing.

6. The waveguide switch of claim 1 wherein the dielectric material of said first and second waveguides is ceramic.

7. The waveguide switch of claim 3 wherein the dielectric material of said third waveguide is ceramic.

8. The waveguide switch of claim 4 wherein said first waveguide is coupled to said first connector means by a first probe means and said second waveguide is coupled to said second connector means by a second probe means.

9. The waveguide switch of claim 8 wherein said first connector means is a first coaxial connector and said second connector means is a second coaxial connector.

10. The waveguide switch of claim 9 wherein said first coaxial probe means is a first probe and said second coaxial probe means is a second probe.

11. A TE mode rotary waveguide switch comprising:

a first TE mode waveguide having a dielectric material therein;

a second TE mode waveguide having a dielectric material therein; and switch means for connecting said first waveguide to said second waveguide, said switch means including a rotor and a stator, said rotor including a third TE mode waveguide having a dielectric material therein and mounted on a rotatable first housing, said stator being a stationary second housing for said first and second waveguides.

12. A waveguide switch comprising:

a first waveguide having a solid dielectric material therein;

a first coaxial probe coupling said first waveguide to a first coaxial connector;

a second waveguide having a solid dielectric material therein;

a second coaxial probe coupling said second wavegude to a second coaxial connector; and switch means for connecting said first waveguide to said second waveguide.

* * * * *